US005419148A

United States Patent [19]

Kuehl et al.

[11] Patent Number: 5,419,148

[45] Date of Patent: May 30, 1995

[54] ELECTRONIC CONTROL MOUNTING SYSTEM FOR A REFRIGERATOR

[75] Inventors: Steven J. Kuehl, Lincoln Township; Donald E. Janke, Benton Township, both of Berrien County, Mich.

[73] Assignee: Whirlpool Corporation, Benton Harbor, Mich.

[21] Appl. No.: 113,002

[22] Filed: Aug. 30, 1993

[51] Int. Cl.[6] ..... F25B 49/02

[52] U.S. Cl. ..... 62/208; 62/130; 374/208

[58] Field of Search ..... 62/208, 203, 186, 187, 62/229, 77, 447, 302, 300, 298, 263, 259.1, 465, 127, 129, 130; 374/148, 208

[56] References Cited

U.S. PATENT DOCUMENTS 4,404,813 9/1983 Paddock et al. ..... 62/127
4,407,141 10/1983 Paddock ..... 62/209 X
4,843,833 7/1989 Polkinghorne ..... 62/127 X

*Primary Examiner*—Harry B. Tanner
*Attorney, Agent, or Firm*—Stephen D. Krefman; Joel M. Van Winkle

[57] ABSTRACT

An electronic control mounting system for a refrigerator. In the refrigerator, a freezer compartment is defined by a freezer liner, a fresh food compartment is defined by a fresh food liner and a partition wall is disposed between the compartments. A mounting plate is disposed between the freezer liner and fresh food liner within the partition wall and includes a mounting boss and a conduit boss. The conduit boss joins a first opening provided in the freezer liner and a second opening provided in the fresh food liner such that a channel is formed between the fresh food compartment and the freezer compartment. A housing member, supporting a control printed circuit board (PC board), is secured to the bottom surface of the partition wall by attachment to the mounting boss provided on the mounting plate. The PC board further includes a first temperature sensor having a pair of extending electrical leads directly soldered or mounted onto the PC board. A support tube extending out from the housing member receives the first temperature sensor such that when the housing assembly is secured to the bottom of the partition wall. The support tube extends up through the channel formed in the partition wall and positions the first temperature sensing means within the freezer. A second temperature sensing means is mounted to the PC board and remains in the fresh food compartment for measuring the fresh food compartment temperature.

24 Claims, 4 Drawing Sheets

ELECTRONIC CONTROL MOUNTING SYSTEM FOR A REFRIGERATOR

BACKGROUND OF THE INVENTION

The present invention relates to an electronic control mounting system for a refrigerator having a fresh food compartment and a freezer compartment and more particularly to an apparatus and method for supporting a control printed circuit board within the fresh food compartment while remotely positioning a temperature sensing means, integrally interconnected with the control printed circuit board, in the freezer compartment.

In a refrigerator having a freezer compartment and a fresh food compartment, the temperature of the respective freezer and fresh food compartments gradually rise due to heat transfer through the walls and door of the refrigerator as well as from the frequent opening of the door or doors of these compartments and loading therein of foods or the like. A control system must be provided, therefore, for receiving operator input and temperature level input for controlling the operation of the refrigerator.

In a typical refrigerator, as shown in U.S. Pat. No. 3,727,419, is provided within a control console disposed in the rear of the fresh food compartment. The control console includes a manually operable air control knob and a manually operable temperature control knob interconnected with a thermostat for controlling the operation of a compressor and evaporator fan, as is well known. The typical thermostat includes a temperature responsive portion having a bellows-type actuator with a temperature sensing portion comprising a conventional fluid filled bulb connected to the bellows by a capillary tube. Refrigerated air may be delivered from the evaporator, located in the freezer compartment, to the fresh food compartment through a suitable air duct terminating in an outlet opening into the fresh food compartment. The temperature sensing bulb is typically disposed adjacent to this outlet opening.

In this well known configuration, therefore, no temperature sensing means is located in the freezer compartment for directly sensing the freezer compartment temperature. Rather the operation of the refrigerator is controlled by sensing the temperature of the air delivered to the fresh food compartment. In advanced refrigeration systems, however, it may be desirable to monitor the temperature of the freezer compartment directly.

Refrigerators have also been provided with electronic controls, as shown in U.S. Pat. No. 4,966,004. Generally, these controls have a microprocessor on a printed circuit board (PC board). Remote temperature sensors, such as negative temperature coefficient resistors (NTCs), may be provided for sensing the temperatures of the fresh food and freezer compartment. These NTCs, however, are located off the PC board and require packaging to satisfy physical mounting and electrical interconnection requirements with the PC board. The electrical interconnection typically involves a wiring harness connected to the NTCs and the PC board and therefore the PC board must also be equipped with a connector to interconnect with the harness. These requirements, driven by the off PC board location, typically increase the cost of each NTC by 300%–400%. In addition to being relatively expensive, these off PC board locations typically are contributors to potential quality problems due to the potential for assembly error in making the required electrical corrections.

It would be an improvement, therefore, over the known refrigeration systems having electronic controls, if a system were provided for mounting NTCs integrally onto a PC board but which included a means for disposing one NTC in the freezer compartment and one NTC in the fresh food compartment. Such a system would provide the benefits of allowing direct measurement of the freezer compartment temperature and the fresh food compartment temperature but would avoid the relatively costly elements of off PC board NTC mounting. Furthermore, product quality may be increased by the reliability of an integral NTC mounting system.

Further, as shown in U.S. Pat. No. 3,727,419, prior art temperature sensing systems typically sense the temperature of air delivered from the evaporator. An improved indication of both the freezer and the fresh food compartment temperature could be obtained, however, by sensing the temperature of air entering the evaporator from the respective freezer and fresh food compartments. This, as can be understood by those of skill in the art, would provide for less on and off cycling of the compressor and fan motors.

Therefore, it would be an improvement in the art if a temperature sensing system were provided such that for both the fresh food compartment and the freezer compartment, temperature sensing means were provided for sensing the temperature of air entering the evaporator rather than air discharged from the evaporator.

SUMMARY OF THE INVENTION

Accordingly, one object of the invention is to provide an improved control mounting system for a refrigerator.

Another object is to provide a control mounting system for a refrigerator wherein a temperature sensor, mounted directly onto a printed circuit board, may be remotely positioned away from the printed circuit board.

Another object is to avoid the relatively high costs of off-PC board interconnections between temperature sensors and an electronic control for a refrigerator control system.

Another object of the invention is to provide a system for mounting a temperature sensor in a refrigerator wherein the sensor is positioned so as to measure the temperature of air entering the evaporator.

Yet another object is to provide a control system for a refrigerant wherein the temperature of a fresh food compartment and a freezer compartment is measured by temperature sensors directly mounted onto a single printed circuit board disposed within one of the refrigerator compartments.

According to the present invention, the foregoing and other objects are attained by a refrigerator having a cabinet structure providing a freezer compartment and a fresh food compartment and including a partition wall separating the compartments. The freezer compartment may be defined by a freezer liner and the fresh food compartment may be defined by a fresh food liner. The partition wall, therefore, includes adjacent portions of the freezer liner and the fresh food liner and a rigid foam insulating layer disposed between the freezer liner and the fresh food liner. A mounting plate is disposed between the freezer liner and fresh food liner in the partition wall and includes a mounting boss and a conduit boss. The conduit portion joins a first opening provided in the freezer liner and a second opening provided in the fresh food liner such that a channel is formed between the fresh food compartment and the freezer compartment.

A housing member, supporting a control printed circuit board (PC board), is secured to the bottom surface of the partition wall by attachment to the mounting boss provided on the mounting plate. The housing member is positioned such that manually operated controls extending from the PC board through the housing are readily accessed by the user of the refrigerator. The PC board further includes a first temperature sensor having a pair of electrical leads directly soldered or mounted onto the PC board. A support tube extending out from the housing member receives the first temperature sensor such that when the housing assembly is secured to the bottom of the partition wall, the support boss extends up through the channel formed in the partition wall and disposes the first temperature sensing means within the freezer. A second temperature sensing means is mounted to the PC board and remains in the fresh food compartment. In this fashion, therefore, a system is provided having a first and second temperature sensing means mounted directly onto a PC board wherein the first temperature sensor is disposed in the freezer compartment and the second temperature sensor is disposed in the fresh food compartment.

DESCRIPTION OF PREFERRED EMBODIMENTS

Figure 2:
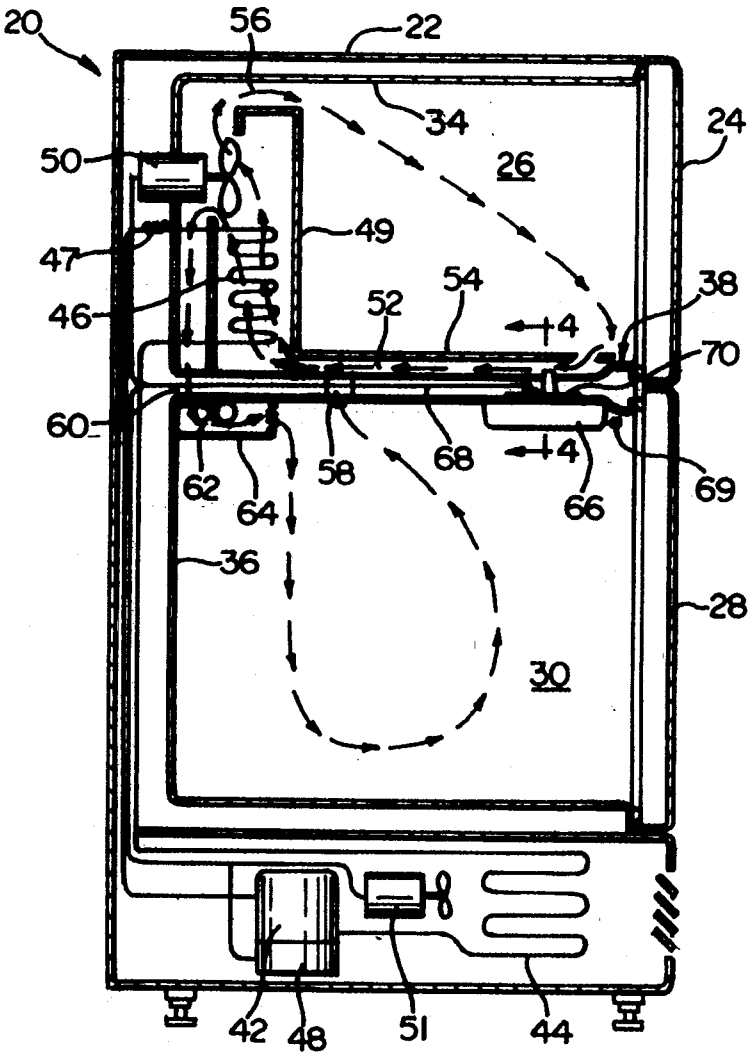
FIG. 2 is a side sectional view of the refrigerator of FIG. 1 taken substantially along lines 2—2 of FIG. 1, wherein the refrigerator has its access doors in the closed position.
Figure 1:
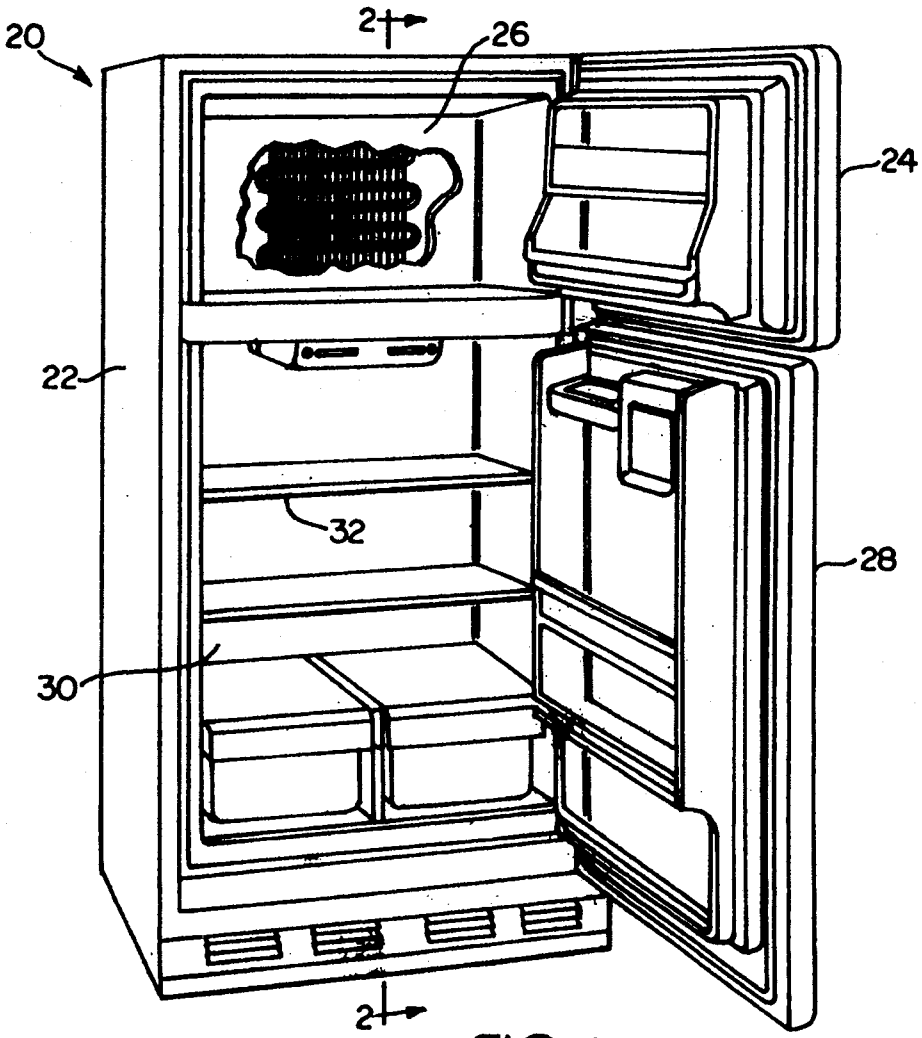
FIG. 1 is a generally frontal perspective view of a refrigerator appliance incorporating the present invention, the refrigerator having its access doors shown in an open position.

In FIGS. 1 and 2 there is shown generally a refrigerator appliance at 20 which comprises an exterior cabinet 22 having a first openable door 24 to expose a first interior compartment or freezer compartment 26 and a second openable door 28 to expose a second interior compartment or fresh food compartment 30. Within each of the compartments 26, 30 there may be one or more shelves 32 for receiving food articles. Generally the freezer compartment 26 will be maintained at a temperature sufficiently below 0° C. to assure that all of the articles contained within that compartment will be maintained in a frozen state. The fresh food compartment 30 generally is maintained somewhat above 0° C. to maintain the items placed therein in a chilled, but not frozen condition.

The refrigerator 20 may be constructed such that the freezer compartment 26 is defined by a freezer liner 34 and the fresh food compartment 30 is defined by a fresh food liner 36. A partition wall 38 separates the freezer compartment from the fresh food compartment. The partition wall 38 includes adjacent portions of the fresh food liner 36, the freezer liner 34 and foam insulation.

In order to maintain the compartments at the desired temperature levels, a refrigeration system is provided which comprises a compressor 42, a condenser 44, an evaporator 46, and a restrictive device 47 such as a capillary tube, in fluid communication with each other. A compressor motor 48 is coupled to the compressor for moving refrigerant through the refrigeration system as is well known. The evaporator 46 is disposed behind a rear wall panel 49 positioned at the back of the freezer compartment 26. An evaporator fan 50, which may be a motor driven fan or blower, is provided for circulating air from each of the compartments 26, 30 over the evaporator 46 to maintain a fairly consistent temperature throughout each compartment. Additionally, a condenser fan 51 may be provided for causing air flow around the condenser 44 to promote heat transfer between the condenser 44 and the surrounding air.

Air circulation within the freezer compartment 26 is caused by the evaporator fan 50 drawing air into a freezer return air duct 52 formed between the freezer liner 34 and a freezer floor panel 54, across the evaporator 46 and out through a freezer air discharge opening 56. The evaporator fan 50 also draws air from the fresh food compartment 30 up into an air intake opening 58 formed into the partition wall 38, across the evaporator 46 and then forces air out through a fresh food air discharge opening 60, for creating air circulation within the fresh food compartment 30. The rate of air recirculation through the fresh food compartment 30 is controlled by a motorized damper assembly 62 which operates to control the air flow through the discharge opening 60. A baffle assembly 64 is provided for dispersing the air exiting the discharge opening 60 throughout the fresh food compartment 30.

The above described refrigerator is the preferred configuration for the present invention, however, the inventors have also contemplated use of the invention in various different refrigerator configurations. For example, the inventors have contemplated utilizing the present invention in a refrigerator having a dual evaporator configured as disclosed in pending U.S. patent application Ser. No. 07/930,968, having a common assignee as the present application and incorporated herein by reference. Additionally, the present invention may be incorporated into a refrigerator having a multi-temperature evaporator system with a variable speed compressor as disclosed in pending U.S. patent application Ser. No. 07/930,104, U.S. Pat. No. 5,231,847, having a common assignee as the present application and incorporated herein by reference.

In order to control the operation of the refrigerator 20, a control system is provided. The control system includes an electronic control means generally designated 67 (FIG. 3), supported within a control housing assembly 66 along the bottom surface of the partition wall 38. The electronic control means 67 is interconnected with the compressor motor 48, the evaporator fan 50, the condenser fan 51 and the motorized damper 62 through a wiring harness 68.

The electronic control means also operates to receive user input from the operator of the refrigerator 20 and temperature inputs from temperature sensing means disposed in both compartments 26 and 30. Therefore, to receive user input, a plurality of manually operable controls 69 are provided, extending through the control housing assembly 66, which interconnect with the electronic control means. Additionally, temperature sensing means are provided for each compartment 26, 30 to provide appropriate signal inputs to the electronic control means.

In the prior art, temperature sensing means for an electronically controlled refrigerator are remotely mounted within each compartments 26, 30 and then interconnected with the electronic control means through a suitable wiring harness. As discussed earlier, this configuration is undesirable for many reasons. The present invention, therefore, provides a novel mounting system for an electronic control system for remotely positioning a temperature sensing means which is integrally interconnected with the electronic control means.

Figure 3:
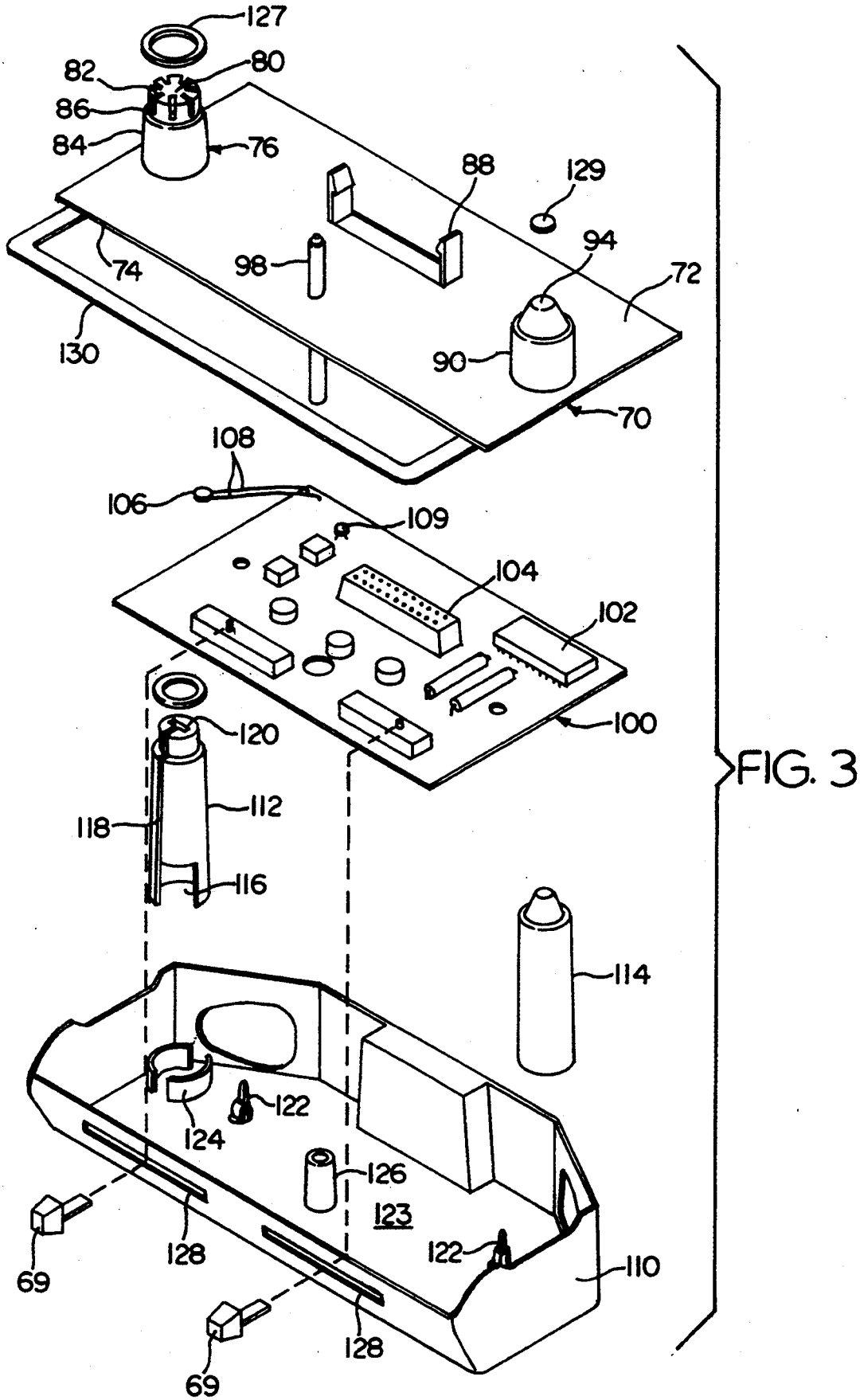
FIG. 3 is an exploded detailed perspective view of the control housing assembly and mounting system shown in FIG. 2.
Figure 4:
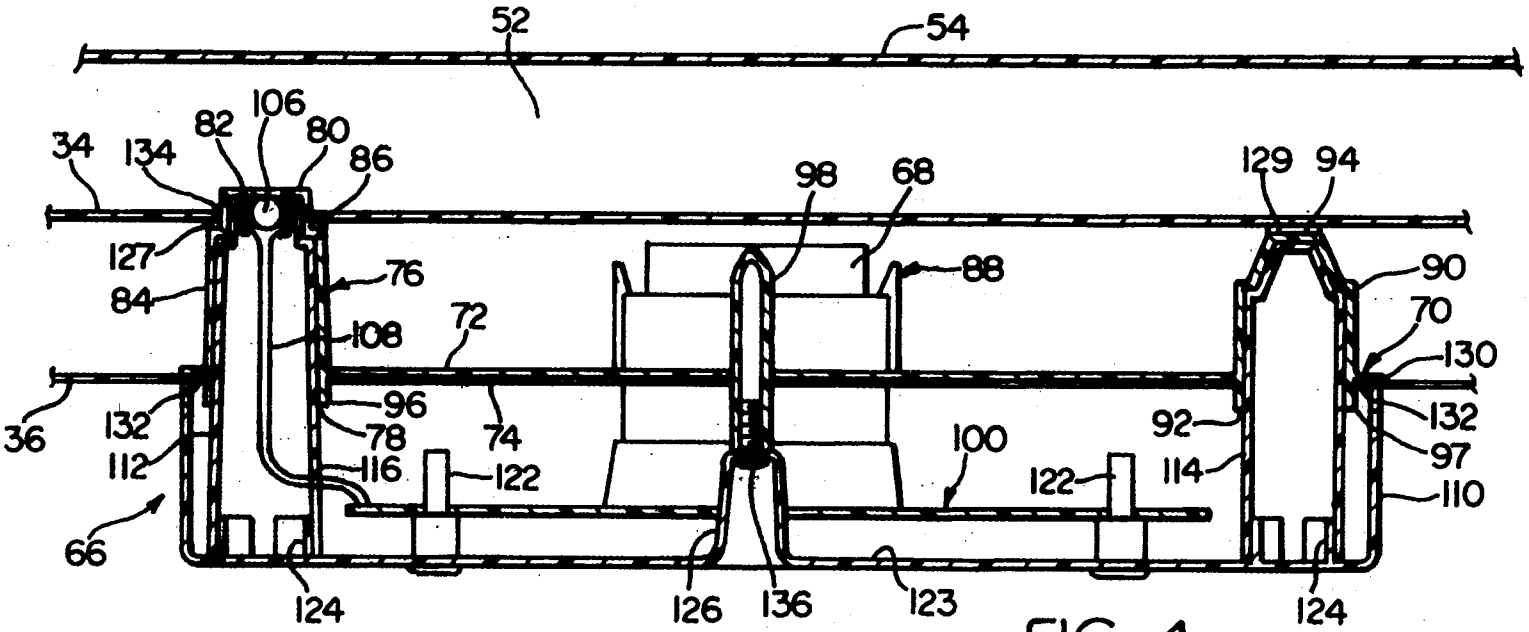
FIG. 4 is a sectional view taken along lines 4—4 of FIG. 2.

In FIGS. 3 and 4, the details of the mounting system for the electronic control means are shown. Located within the partition wall is a mounting plate 70 having an upper surface 72 and a bottom surface 74. Extending from the upper surface 72 is a conduit boss 76 having an open bottom portion 78 and a closed top portion 80. A plurality of vent openings 82 are provided through the top portion 80 of the conduit boss 76. The conduit boss 76 is configured to have a generally tapered main body 84 and a shoulder surface 86. The mounting plate 70 further includes a wiring harness connection means 88. The wiring harness connection means 88 may be a connection means as disclosed in pending U.S. patent application Ser. No. 07/914,324, having a common assignee as the present application and incorporated herein by reference. A generally tapered guide boss 90 having an open bottom portion 92 and a top surface 94 may also be provided, extending from the upper surface 72 of the mounting plate 70. A first annular rib 96 and a second annular rib 97 are provided extending from the bottom surface 74 of the mounting plate 70 around the peripheral edge of the open bottom portions 78 and 92. Finally, a mounting boss 98 may be provided extending from both the top surface 72 and the bottom surface 74 of the mounting plate 70.

As stated above, the control housing assembly 66 supports the electronic control means. The electronic control means comprises a control printed circuit board (PC board) 100 supporting a microprocessor 102, a connection 17ss 104, and a plurality of other electrical control components. Additionally, extending from the PC board 100 is a first temperature sensing means or freezer thermistor 106 having a pair of electrical leads 108 directly soldered or mounted onto the PC board 100. A second temperature sensing means or fresh food thermistor 109 is also mounted directly onto the PC board 100. The fresh food thermistor 109 is shown having relatively short leads, but may be alternatively connected to the PC board 100 by way of relatively long leads, similar to those extending from the freezer thermistor 106. In this fashion, the fresh food thermistor 109 may be remotely positioned away from the PC board 100 for optimum temperature sensing of the fresh food compartment 30. For example, the fresh food thermistor 109 may be positioned to extend through a hole 111 in the housing member 110.

The control housing assembly 66 comprises a plurality of components including a housing member 110, a support tube 112 and a generally tapered guide boss 114. The support tube 112 is a hollow member and includes a cut away portion 116 and an axial slit 118 extending from the cut away portion 116 to a top surface 120 of the support tube 112. Extending from a bottom wall 123 of the housing member 110 are a plurality of support ribs 124 for securing the support tube 112 and the guide boss 114 to the housing member 110. A plurality of support members 122 are provided for retaining and securing the PC board 100 within the housing member 110 as is known. A connection boss 126 is also formed into the bottom wall 123 of the housing member 110. Additionally, a plurality of slots 128 are provided in the housing member such that the manually operable controls 69 may extend through the slots 128 and interconnect with control elements provided on the PC board 100.

FIG. 4 illustrates the assembly of the electronic control mounting system and shows the mounting plate 70 disposed between the fresh food liner 36 and the freezer liner 34. As shown, an annular double sided adhesive member 127 and a circular double sided adhesive member 129 serve to adhere the mounting plate 70 to the freezer liner 34. A gasket 130 seals the bottom surface 74 of the mounting plate 70 to the fresh food liner 36. Openings or holes 132 are formed into the fresh food liner 36 such that the annular ribs 96 and 97 of the mounting plate 70 extend through the fresh food liner 36. Furthermore, an opening or hole 134 is formed into the freezer liner 34 such that the top portion 80 of the conduit boss 76 of the mounting plate 70 extends through the freezer liner 34 into the freezer return air duct 52. In this fashion, therefore, a channel is formed between the fresh food compartment 30 and the freezer compartment 26. Additionally, the wiring harness connection means 88 of the mounting plate 70 interconnects with the wiring harness 68 such that the terminal connection portion of the wiring harness is positioned into the fresh food compartment 30.

As discussed above, support members 122 interconnect with the housing member 110 and support and secure the PC board 100 within the housing member 110. The housing member 110 is secured adjacent to the partition wall 38 by a threaded fastener 136 which extends up through the connection boss 126 and threads into the mounting boss 98. The PC board 110, therefore, is supported for interconnection with the terminal connection portion of wiring harness 68. In this fashion also, the control means are disposed beneath the partition wall 38 for convenient access by the operator of the refrigerator 20.

The support tube 112, extending from the housing member 110, provides a support means for the freezer thermistor 106 such that, while the PC board 100 is disposed within the fresh food compartment 30, the freezer thermistor 106 may be disposed in the freezer compartment 26. This may be accomplished by inserting the leads 108 of the freezer thermistor 106 into the axial slit 118 formed on the support tube 112 such that the freezer thermistor 106 is positioned above and adjacent the top surface 120 of the support tube 112. Assembling the housing member 110 to the mounting plate 70 causes the support tube 112 to extend up through the conduit boss 76 such that the freezer thermistor 106 is disposed adjacent to the vent openings 82 provided in the top portion of the conduit boss 76. In this fashion therefore, the freezer thermistor 106 may sense the temperature of air flowing through the freezer return air duct 52.

The method of assembling the present invention may be further understood from the following discussion. The mounting plate 70 may be initially interconnected with the freezer liner 34 by way of the double sided adhesive members 127 and 129. At the same time, the wiring harness 68 may be interconnected with the freezer liner 34 and the mounting plate 70. The freezer liner 34 may then be positioned within the cabinet 22. Subsequently, the fresh food liner 36 may be positioned into the cabinet 22 such that the annular ribs 96, 97 of the mounting plate 70 extend through the openings 132 of the fresh food liner 36. A gasket 130 is captured between the fresh food liner 36 and the mounting plate 70 such that the openings 132 in the fresh food liner 36 are effectively sealed as is well known in the art, to prevent foam, injected between the respective liners 34, 36 and the cabinet 22 from leaking into the fresh food compartment 30.

The control housing assembly 66, including the PC board 100, is assembled prior to connection with the partition wall 38. This may be done by assembling the support tube 112 and the guide boss 114 onto the housing member 110 and securing the PC board 100 to the housing member 110. The freezer thermistor 106 may be positioned into the support tube 112 as described above.

The positioning of the control housing assembly 66, relative to the partition wall 38, prior to driving fastener 136, is accomplished by locating the top portions of the support tube 112 and the guide boss 114 into the open bottom portions 78, 92 of the conduit boss 76 and the guide boss 90, respectively. Once correctly located, the control housing assembly 66 including the PC board 100, may be forced upward such that the support tube 112 and the guide boss 114 extend completely up inside the respective conduit boss 76 and guide boss 90. Additionally, forcing the control housing assembly 66, including the PC board 100, upward causes the connection buss 104 and the terminal connection portion of the wiring harness 68 to interconnect such that the electronic control means is interconnected with the electrical elements of the refrigerator 20. The fastener 136 may be driven up through the connection boss 126 into the mounting boss 98 to secure the housing assembly 66 to the partition wall 38.

Figure 5:
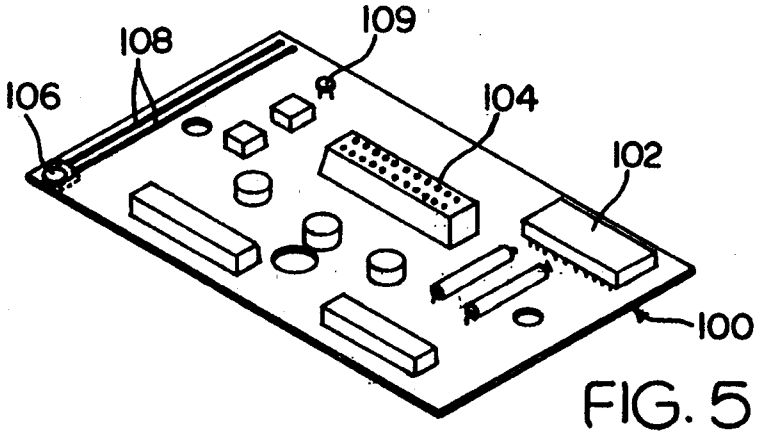
FIG. 5 is an alternate embodiment of the control printed circuit board of FIG. 3.

FIG. 5 illustrates an alternative embodiment of the PC board 100 configuration, and more specifically the configuration of the freezer thermistor 106. In this embodiment, in contrast to having the freezer thermistor 106 extend from the PC board 100 on the relatively long leads 108, the freezer thermistor 106, having more conventional short leads, is mounted to a break-away or frangible portion 140 of the PC board 100. A pair of wires 142 interconnect the main portion of the PC board 100 with the break-away 140. In this fashion, the break-away portion 140 may be separated from the main body of the PC board 100, wherein the freezer thermistor 106 along with the break-away portion 140 may be remotely positioned away from the PC board 100 in accordance with the present invention.

Figure 6:
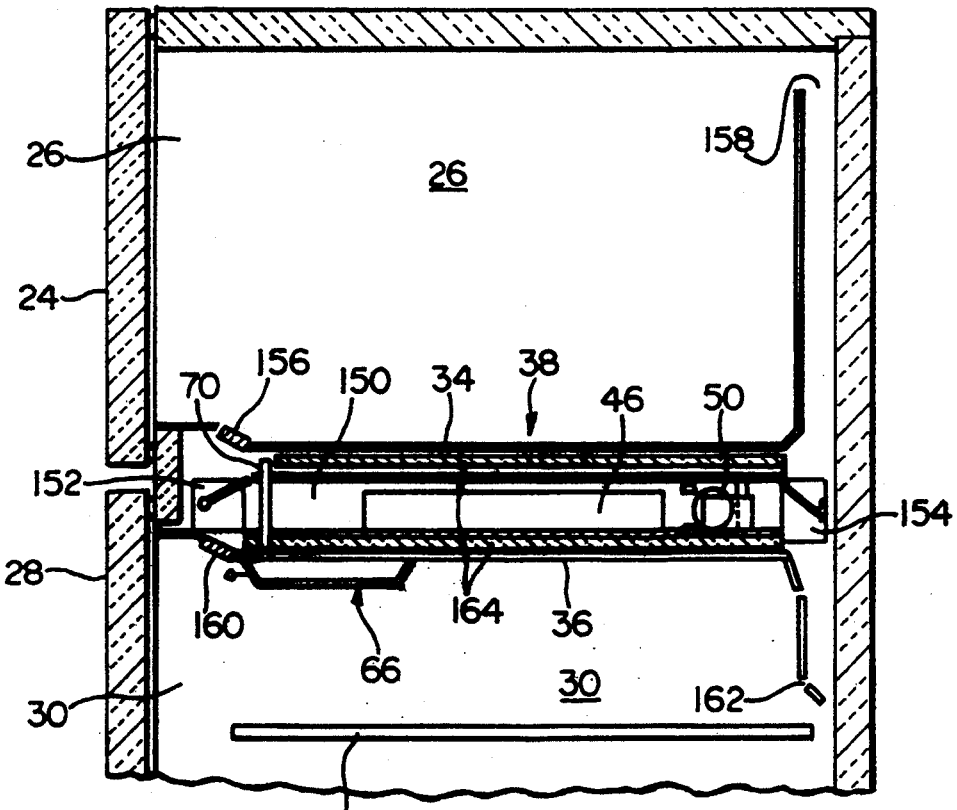
FIG. 6 is a side, sectional view of a refrigerator illustrating an alternative refrigerator system incorporating the control mounting system of the present invention.

FIG. 6 illustrates an alternative refrigerator configuration including the novel electronic control mounting system of the present invention. This refrigeration system is similar to the refrigeration system disclosed in pending U.S. patent application Ser. No. 07/930,104 having a common assignee as the present application and incorporated by reference.

In this configuration, the evaporator 46 may be disposed in a plenum 150 disposed within the partition wall 38. The evaporator fan 50 is also disposed in the plenum 150 and two air dampers 152, 154 are provided to direct the air flow from either the freezer compartment 26 or the fresh food compartment 30 over the evaporator 46 in a sequential manner. Air flow from either compartment 26 or 30 through the evaporator 46 is channelled through a freezer compartment air inlet 156 and outlet 158 or a fresh food compartment air inlet 160 and outlet 162. Foam insulation 164 may be provided for insulating the plenum 150 from the compartments 26 and 30.

In a similar fashion as described above, therefore, the control housing assembly 66 may be mounted along the bottom surface of the partition wall 38. A temperature sensing means, directly mounted onto a PC board disposed within the control housing assembly 66, may be remotely positioned in the freezer compartment 26, extending through the plenum 150, for sensing the temperature of the freezer compartment 26.

Figure 7:
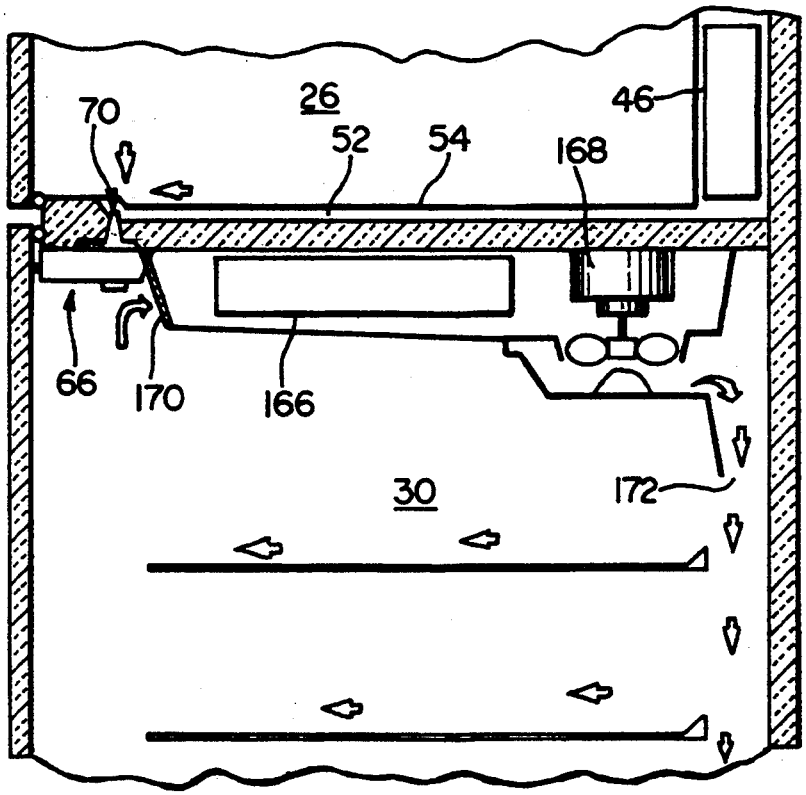
FIG. 7 is a side, sectional view of a refrigerator illustrating a second alternative refrigerator system incorporating the control mounting system of the present invention.

FIG. 7 illustrates a second alternative refrigerator configuration including the novel electronic control mounting system of the present invention. This refrigeration system is similar to the refrigeration system disclosed in pending U.S. patent application Ser. No. 07/930,968, having a common assignee as the present application and incorporated by reference.

In this configuration, a second evaporator 166 is provided for the fresh food compartment 30. A separate fan 168 is also provided for moving air within the fresh food compartment 30 over the second evaporator 166 through inlet opening 170 and outlet opening 172.

In a similar fashion as described above, therefore, the control housing assembly 66 may be mounted along the bottom surface of the partition wall 38. A temperature sensing means, directly mounted onto a PC board disposed within the control housing assembly 66, may be removably positioned within the return air duct 52, for sensing the temperature of the freezer compartment 26.

It can be seen, therefore, that a novel mounting system for an electronic control has been provided by the present invention. The unique mounting system allows easy installation of the control assembly and provides for remote positioning of temperature sensors, directly mounted onto the printed circuit board, within both the fresh food compartment and the freezer compartment. In this fashion, relatively easy assembly of the refrigerator is made possible and the relatively costly off-board mounting and interconnections between temperature sensors and the printed circuit board are avoided.

Although the present invention has been described with reference to a specific embodiment, those of skill in the art will recognize that changes may be thereto without departing from the scope and spirit of the invention as set forth in the appended claims.

We claim:

1. A refrigerator apparatus having a cabinet defining a first compartment and a second compartment, comprising:

a partition wall separating said first compartment and said second compartment;

an electronic circuit means disposed adjacent said partition wall in said second compartment;

a temperature sensing mean having extending leads directly mounted onto said electronic circuit means; and means for disposing said temperature sensing means in said first compartment.

2. A refrigerator apparatus according to claim 1, wherein said first compartment is a freezer compartment and said second compartment is a fresh food compartment.

3. A refrigerator apparatus according to claim 2 further comprising a freezer return air duct, said temperature sensing means being disposed in said freezer return air duct.

4. A refrigerator apparatus according to claim 1 wherein said electronic circuit means comprises:

a board having a frangible portion supporting said temperature sensing means such that said board may be separated into two portions, and a pair of wires interconnecting the frangible portion with said electronic circuit means such that said temperature sensing means may be positioned remotely from said electronic circuit means.

5. A refrigerator apparatus according to claim 1 further comprising:

a second temperature sensing means directly mounted onto said electronic circuit means; and means for disposing said second temperature sensing means in said second compartment.

6. A refrigerator apparatus according to claim 1 further comprising:

a mounting plate disposed within said partition wall, said mounting plate having a conduit boss for providing a channel between said first compartment and said second compartment.

7. A refrigerator apparatus according to claim 6 further comprising:

a control housing assembly including:

a housing member having means for supporting said electronic circuit means adjacent said partition wall within said second compartment;

a support tube interconnected with said housing member, said support tube extending outwardly from said housing member, said support tube further being disposed within said conduit boss and supporting said temperature sensing means such that said temperature sensing means is disposed in said first compartment.

8. A refrigerator apparatus according to claim 1 wherein said partition wall further comprises:

a freezer liner having a first opening:

a fresh food liner having a second opening;

a rigid foam insulating layer disposed between said freezer liner and said fresh food liner wherein said freezer liner, said fresh food liner and said rigid foam insulating layer are substantially bonded together; and a mounting plate having a conduit boss sealingly interconnecting said first opening and said second opening for providing a channel between said first compartment and said second compartment.

9. A refrigerator apparatus having a cabinet defining a first compartment and a second compartment, comprising:

a partition wall separating said first compartment and said second compartment having a channel interconnecting said second compartment and said first compartment;

a printed circuit control board;

a control housing assembly for supporting said printed circuit board adjacent said partition wall in said second compartment;

a temperature sensing means having extending leads mounted directly onto said printed circuit board;

a support tube extending from said control housing assembly and having a top surface for supporting said temperature sensing means, said support tube being disposed within said channel such that said temperature sensing means is disposed within said first compartment for sensing the temperature of said first compartment.

10. A refrigerator apparatus according to claim 9, wherein said first compartment is a freezer compartment and said second compartment is a fresh food compartment.

11. A refrigerator apparatus according to claim 10 further comprising a freezer return air duct wherein said temperature sensing means is disposed in said freezer return air duct.

12. A refrigerator apparatus according to claim 10 further comprising:

a second temperature sensing means directly mounted onto said printed control board wherein said second temperature sensing means is disposed within said fresh food compartment.

13. A refrigerator apparatus according to claim 10 further comprising:

a mounting plate disposed within said partition wall, said mounting plate having a conduit boss for providing said channel between said freezer compartment and said fresh food compartment.

14. A refrigerator apparatus according to claim 13 wherein said control housing assembly further comprises:

a housing member; and a plurality of support members interconnected with said housing member for supporting said printed control board, said support tube interconnecting with said housing member and extending outwardly from said housing member, said support tube being disposed within said conduit boss and supporting said temperature sensing means such that said temperature sensing means is disposed in said freezer compartment.

15. A refrigerator apparatus according to claim 10 wherein said partition wall further comprises:

a freezer liner having a first opening:

a fresh food liner having a second opening;

a rigid foam insulating layer disposed between said freezer liner and said fresh food liner wherein said freezer liner, said fresh food liner and said rigid foam insulating layer are substantially bonded together; and a mounting plate having a conduit boss sealingly interconnecting said first opening and said second opening for providing a channel between said freezer compartment and said fresh food compartment.

16. A refrigerator apparatus having a cabinet defining a freezer compartment and a fresh food compartment, comprising:

a partition wall separating said freezer compartment and said fresh food compartment;

an electronic circuit means;

a temperature sensing means having extending leads mounted onto said electronic circuit means;

means for positioning said electronic circuit means in said fresh food compartment adjacent said partition wall;

means for supporting said first temperature sensing means; and means for providing access from said fresh food compartment through said partition wall into said freezer compartment such that said support means disposes said first temperature sensing means in said freezer compartment.

17. A refrigerator apparatus according to claim 16 wherein said means for positioning said electronic circuit means in said fresh food compartment further comprising:

a housing member for enclosing and supporting said electronic circuit means; and means for securing said housing member to said partition wall.

18. A refrigerator apparatus according to claim 16 further comprising:

a second temperature sensing means directly mounted onto said electronic circuit means, said second temperature sensing means being disposed in said fresh food chamber.

19. A refrigerator apparatus according to claim 16 wherein said partition wall further comprises:

a freezer liner having a first opening;

a fresh food liner having a second opening; and a rigid foam insulating layer disposed between said freezer liner and said fresh food liner wherein said freezer liner, said fresh food liner and said rigid foam insulating layer are substantially bonded together.

20. A refrigerator apparatus according to claim 19 further comprising:

a mounting plate having a conduit boss sealingly interconnecting said first opening and said second opening for providing a channel between said freezer compartment and said fresh food compartment.

21. A refrigerator apparatus according to claim 20 wherein said support means for supporting said temperature sensing means extends outwardly from said housing member such that disposing said electronic circuit means along said partition wall disposes said support means within said channel such that said temperature sensing means is disposed in said freezer compartment.

22. A refrigerator apparatus according to claim 16 further comprising a freezer return air duct wherein said support means supports said temperature sensing means in said freezer return air duct.

23. A method of manufacturing a refrigerator apparatus having a cabinet defining a freezer compartment and a fresh food compartment, wherein said freezer compartment and said fresh food compartment are separated by a partition wall including a freezer liner and a fresh food liner, said method comprising the steps of:

forming corresponding openings in said freezer liner and said fresh food liner;

positioning a mounting plate on said partition wall having a conduit boss for sealingly interconnecting said corresponding openings such that a channel is formed between said fresh food compartment and said freezer compartment;

injecting a foamed-in-place insulation between said freezer liner and said fresh food liner, said conduit boss of said mounting plate provides said channel between said fresh food compartment and said freezer compartment after said foamed-in-place insulation has been injected between said freezer liner and said fresh food liner;

mounting an electronic circuit means adjacent said partition wall within said fresh food compartment, said electronic circuit means having a first temperature sensing means integrally interconnected with said electronic circuit means; and inserting said first temperature sensing means through said channel formed in said partition wall into said freezer compartment.

24. A method of manufacturing a refrigerator apparatus according to claim 23, further comprising:

providing a housing member;

disposing said electronic control means within said housing member;

positioning said temperature sensing means onto a support tube extending from said housing member;

inserting said support tube into said channel formed in said partition wall; and mounting said housing member to said partition wall, wherein said temperature sensing means is disposed within said freezer compartment.

* * * * *